US007773464B2

(12) United States Patent
Rogers

(10) Patent No.: US 7,773,464 B2
(45) Date of Patent: Aug. 10, 2010

(54) ELAPSED TIME DEVICE

(76) Inventor: Janice L. Rogers, 7695 Cayuga Dr., Cincinnati, OH (US) 45243

( * ) Notice: Subject to any disclaimer, the term of this patent is extended or adjusted under 35 U.S.C. 154(b) by 170 days.

(21) Appl. No.: 11/875,408

(22) Filed: Oct. 19, 2007

(65) Prior Publication Data

US 2008/0253234 A1 Oct. 16, 2008

Related U.S. Application Data

(60) Provisional application No. 60/852,739, filed on Oct. 19, 2006.

(51) Int. Cl.
*G04C 17/02* (2006.01)

(52) U.S. Cl. ..... 368/240

(58) Field of Classification Search ..... 368/107–110, 368/113, 240, 242
See application file for complete search history.

(56) References Cited

U.S. PATENT DOCUMENTS

| | | | | |
|---|---|---|---|---|
| 3,456,152 | A * | 7/1969 | Andersen | 368/82 |
| 4,198,810 | A * | 4/1980 | Fahrenschon | 368/239 |
| 4,250,572 | A * | 2/1981 | Yoshida | 368/71 |
| 4,255,806 | A * | 3/1981 | Fahrenschon et al. | 368/240 |
| 4,277,840 | A * | 7/1981 | Sekiya et al. | 368/71 |
| 4,355,380 | A * | 10/1982 | Huguenin et al. | 368/71 |
| 4,435,046 | A * | 3/1984 | Nishimura | 349/142 |
| 4,540,242 | A * | 9/1985 | Shibuya et al. | 349/83 |
| 4,742,501 | A * | 5/1988 | Coster | 368/82 |
| 4,783,773 | A * | 11/1988 | Houlihan et al. | 368/108 |
| D369,619 | S | 5/1996 | Rogers | |
| 5,662,479 | A * | 9/1997 | Rogers | 434/304 |
| 5,995,456 | A * | 11/1999 | Brewer et al. | 368/84 |
| 6,198,698 | B1 | 3/2001 | Graves | |
| 6,388,952 | B2 * | 5/2002 | Kim | 368/74 |
| 7,505,374 | B2 * | 3/2009 | Booty et al. | 368/223 |

* cited by examiner

*Primary Examiner*—Edwin A. Leon
(74) *Attorney, Agent, or Firm*—Wood, Herron & Evans, LLP

(57) ABSTRACT

An elapsed time and remaining time liquid crystal measuring device having a display face around the periphery of which there are a plurality of numerical indicia marks arranged in a generally clockwise pattern with successive numerical indicia marks decreasing in numerical value in a clockwise direction from a twelve o'clock position. An annular ring of electronically generated graphic indicia are visible on the display face and spaced inwardly from the peripheral numerical indicia and a digital numerical read-out display of elapsed times is visible internally of the annular ring of graphic indicia. There is at least one electronic control element for setting a desired elapsed set time into the device, which desired elapsed set time is indicated both on the digital read-out display and as a complete ring or an arcuate section of the annular ring on the display face. There is also an actuator for initiating progressive clockwise disappearing movement of the electronically generated graphic indicia so as to expose decreasing areas of the annular ring in a clockwise direction as time elapses and while the digital numerical display remains synchronized with the graphic indicia until all of the set time has elapsed. Preferably, the device is in the form of a wrist watch.

21 Claims, 4 Drawing Sheets

ELAPSED TIME DEVICE

CROSS REFERENCE TO RELATED APPLICATIONS

This application claims the benefit of the filing of U.S. provisional Patent Application Ser. No. 60/852,739, filed Oct. 19, 2006, entitled "Time Timer Wrist Timer and Watch Plus" , which is fully incorporated by reference herein.

FIELD OF THE INVENTION

This invention relates to a liquid crystal elapsed time display device and, more particularly, to such a device which displays remaining elapsed time in a graphic form on the face of the device. In one preferred embodiment, the device also is operative to display the time of day as well as elapsed time in alternative modes of operation of the device. Preferably, the device is in the form of a liquid crystal display wrist watch.

BACKGROUND OF THE INVENTION

In an earlier patent, U.S. Pat. No. 5,662,479, there is disclosed a mechanical device for displaying, in graphic form, remaining elapsed time. According to the disclosure of that patent, there is a stationary face on the display device having a plurality of numerical indicia arranged around the periphery of the face in a generally clockwise pattern with successive indicia decreasing in value from 60 to 0 from a 12 o'clock position. A rotating face of the device rotates in the clockwise direction on the stationary face and exposes a decreasing portion thereof in front of the stationary face as time elapses. The ever decreasing exposed portion of the rotating face corresponds to the time remaining of a set elapsed time.

That mechanical device disclosed in U.S. Pat. No. 5,662,479 has numerous limitations because of its mechanical configuration. Among those limitations is one of size, as well as portability and convenience in use. Other limitations are time limitations in that that mechanical device is not amenable to time settings of more than one hour.

It is therefore an objective of this invention to overcome these constraints and limitations of the mechanical device disclosed in the above-identified U.S. patent.

Still another objective of this invention has been to create an elapsed time and remaining time device which lends itself to a wrist watch format while still enabling elapsed time and remaining time to be graphically displayed on the device.

Still another objective of this invention has been to provide an elapsed time and remaining time graphic display device which may be set for more than one hour of time as, for example, up to twelve hours of time.

SUMMARY OF THE INVENTION

The elapsed time and remaining time device of this invention comprises a liquid crystal display having a display face upon which an annular ring or disc of electronically generated graphic indicia in the form of radially extending pixels are visible on the display face. Preferably, there is also a digital numerical read-out display of elapsed time located internally of the annular ring of graphic indicia. The device includes at least one electronic control element in the form of a push button control for setting a desired elapsed set time into the device, which desired elapsed set time is indicated both as a complete ring or an arcuate section of an annular ring of the display face and on the digital read-out display. Additionally, there is an actuator for initiating progressive clockwise disappearing movement of the electronically generated graphic pixel indicia so as to expose decreasing areas of the annular ring in a clockwise direction as time elapses until all graphic indicia disappear when the whole of the set elapsed time has elapsed. In those embodiments where there is a digital numerical display located internally of the annular ring of graphic indicia, that numerical display remains synchronized with the graphic indicia so as to numerically display, as well as graphically display, remaining elapsed time.

In a preferred embodiment of the invention, there is also a second sweep hand indicia in the form of a moving radially extending pixel operable to make one revolution of movement during each minute of operation of the elapsed time. The device may also be operable in several different modes, in which event, there is a mode control actuator or button on the device to convert from one mode of operation to another which converts the device from a liquid crystal display elapsed and remaining timing device to a time-of-day device which may display the time of day in a conventional digital format or in a more conventional analog time-of-day display wherein the hands of the display point to the time of day.

The invention of this application, whether used in a watch format or as a stand-alone display, has numerous applications. For example, in the workplace, it may be used to time and visually display seminars, meetings, panel discussions and presentations. It may also be used to quantify time left before appointments and deadlines, to monitor break time, to manage progress toward goals and agenda items, to oversee skills tests or to regulate computer time and break time.

The invention of this application may also be used in a classroom setting to set time limits, measure the duration of activities and train students to make better use of available time. For example, in the classroom, the device may be used to time standardized tests, monitor math and writing speed tests, measure study periods and lunch periods, regulate computer time or administer duration drills.

The watch format of this elapsed time display is particularly advantageous to satisfy the needs of individuals with "special needs" who require "assistive technology" which is both portable and discrete. The invention of this application provides a solution to both of these needs in that, as a watch, it may be worn rather than carried, and has a look of a typical watch, so as not to call attention to the user.

These and other objectives, advantageous uses and advantages of this invention will become more readily apparent from the following description of the drawings.

Figure 1:
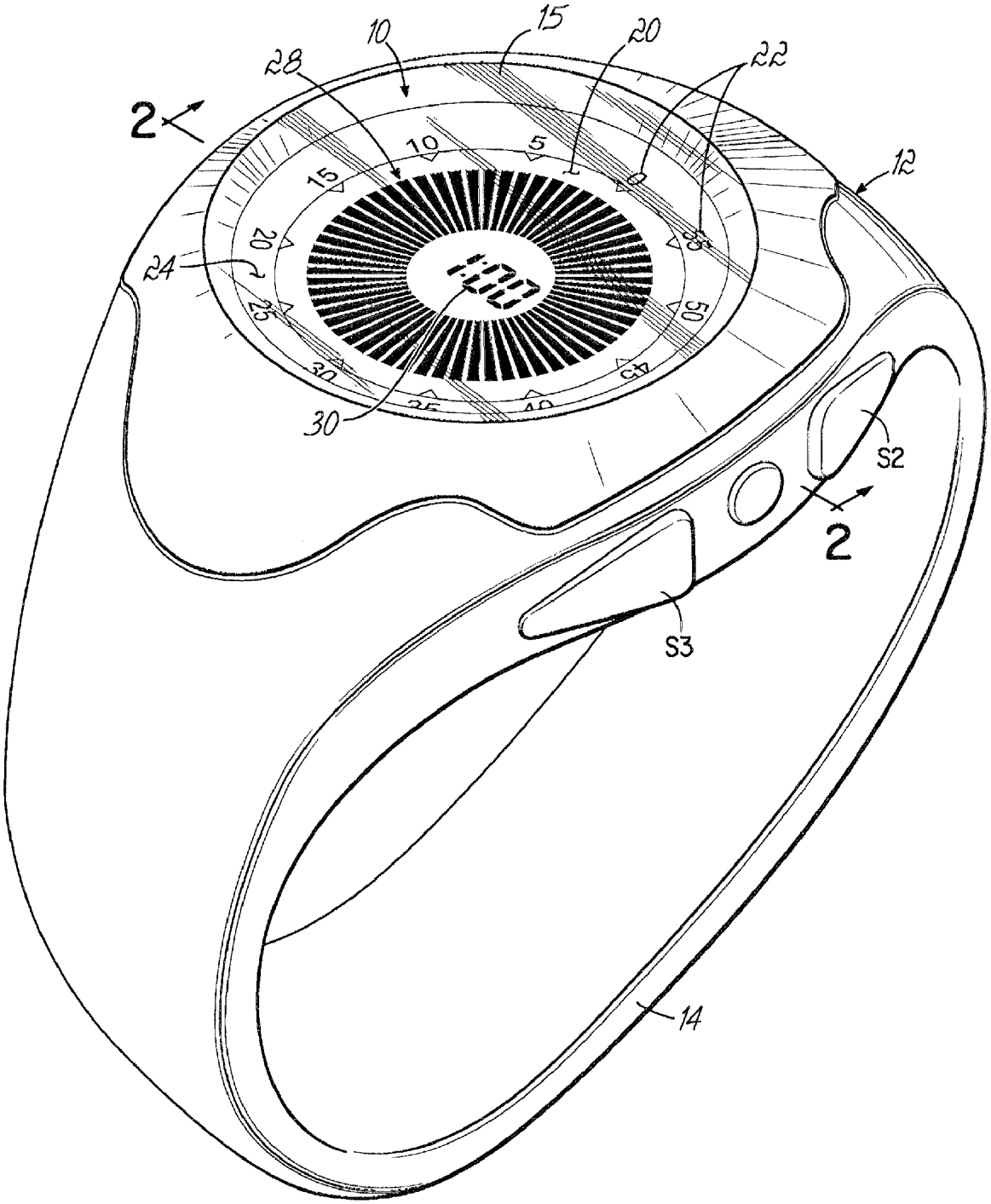
FIG. 1 is a perspective view of a wrist watch incorporating the invention of this application.

The accompanying drawings, which are incorporated and constitute a part of the specification, illustrate embodiments of the invention and, together with a general description of the invention given above, and the detailed description of the embodiments given below, serve to explain the principals of the invention.

DETAILED DESCRIPTION OF SPECIFIC EMBODIMENTS

The elapsed time and remaining time liquid crystal display device 10 of this invention is illustrated in the drawings as embodied in a wrist watch, but it could just as well be applied to and incorporated in a free standing display device. In accordance with the practice of the illustrated embodiment of the invention, the device 10 is contained within a watch case 12 which is, in turn, encased within a molded wrist watch band 14. The band 14 is molded around the case 12 and includes four control or actuating buttons, S1, S2, S3 and S4. As explained more fully hereinafter, these buttons S1, S2, S3 and S4 actuate switches contained internally of the case 12 which, in turn, control setting and actuation of the mechanism contained within the case 12 of the device.

Figure 2:
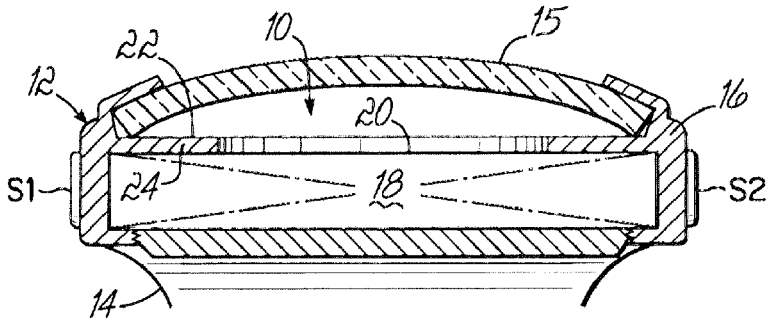
FIG. 2 is a partially schematic cross sectional view taken on line 2-2 of FIG. 1.

With reference to the cross sectional view of FIG. 2, it will be seen that the device 10 includes an external housing or body 16 internally of which there is located a liquid crystal display mechanism 18. A lens 15 covers the top portion of the housing body 16 and is located over the face 20 of the liquid crystal display. Since liquid crystal displays are well known in the watch and timing art, and, once the functions are known, the control circuit and/or control chip may be readily supplied by a person skilled in this art, the control circuit of this mechanism 18 has not been illustrated and described in detail herein. It is only the display and modes of operation of the device associated with this mechanism 18 which incorporates and embodies the invention of this application.

The face of the device 10 has a plurality of numerical indicia marks 22 arranged around the periphery of the display face 20 of the liquid crystal display in a generally clockwise pattern from a 12 o'clock position at which there is located a zero indicia. These numerical indicia are fixedly printed or applied to a flange 24 contained within the watch case 12. These numerical indicia, in increments of 5, are arranged in decreasing numerical value in a clockwise direction from a 12 o'clock position from the numeral 55 to the numeral 0 at the 12 o'clock position.

The liquid crystal display device 18 of this invention has two modes of operation. Those two modes are elapsed time mode illustrated in FIGS. 1, 3, 4 and 5 and time-of-day mode illustrated in FIG. 6. The button S4 controls switching from one mode to the other.

In the elapsed time mode, the face of the liquid crystal display is operative to display an annular ring of electronically generated graphic indicia 28 or pixels visible on the face 20 of the liquid crystal display. In the center of the graphic indicia, there is a digital numeric display 30 of the remaining elapsed time. The annular ring of electronically generated graphic indicia 28 are in the form of wedge-shaped pixels which are preferably 60 in number.

Figure 3:
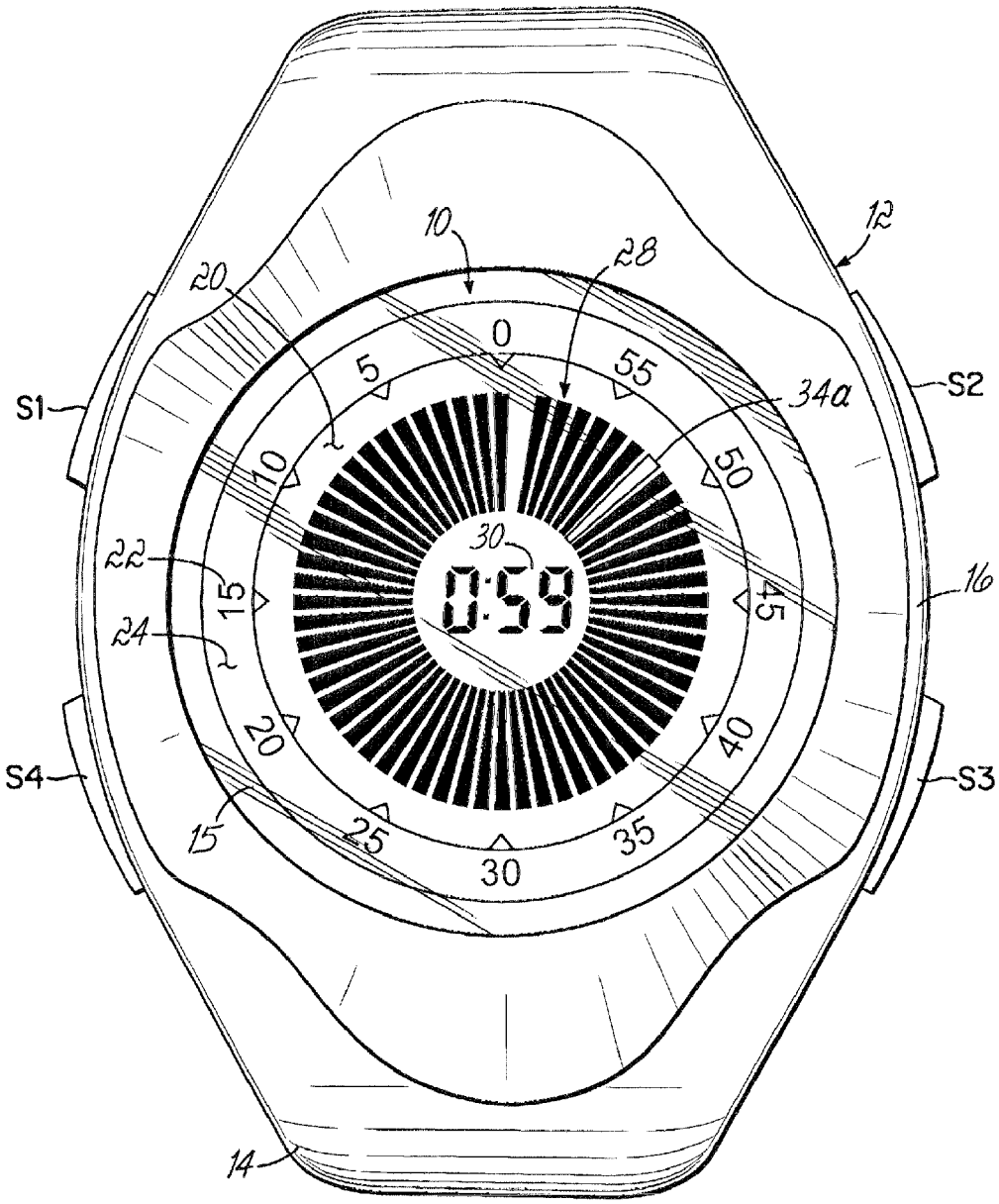
FIG. 3 is a front elevational view of the watch of FIG. 1 illustrating the watch in a setting with 59 minutes remaining of a set elapsed time.
Figure 4:
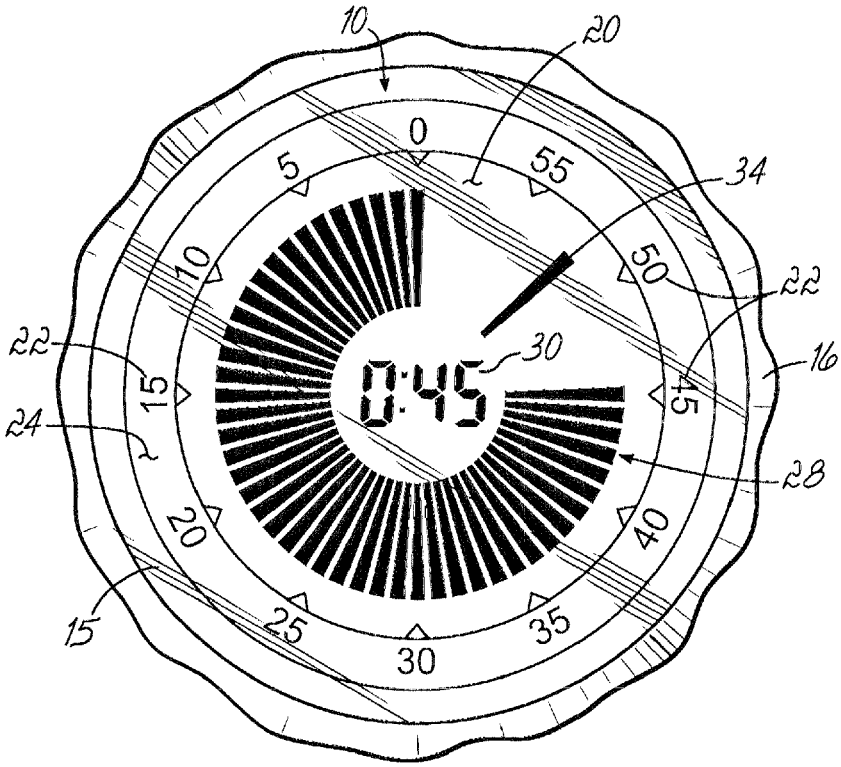
FIG. 4 is a view similar to FIG. 3, but illustrating a setting of 45 minutes remaining elapsed time.
Figure 5:
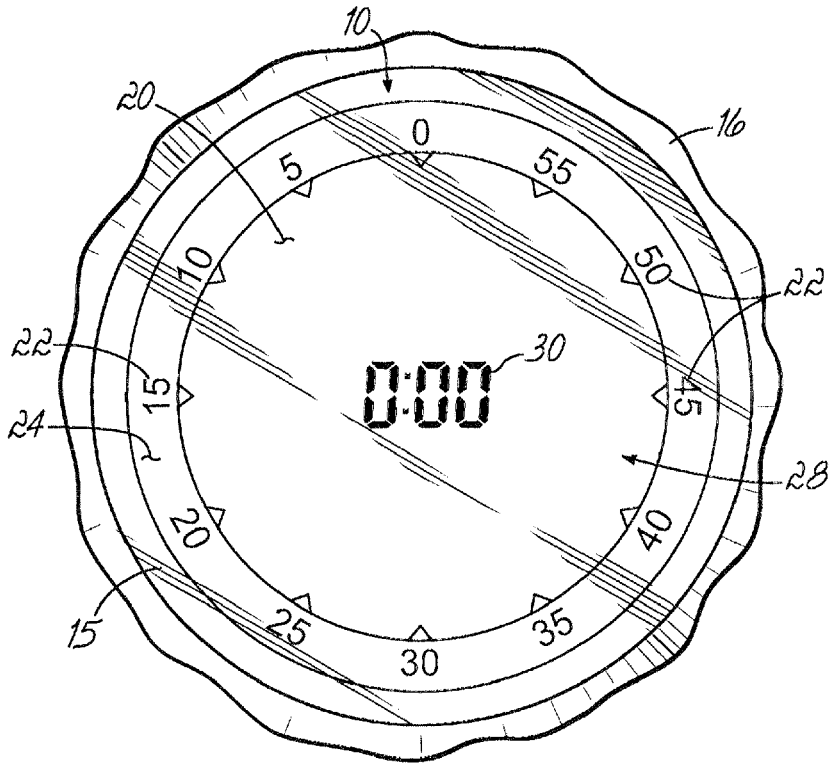
FIG. 5 is a view similar to FIG. 3, but illustrating the watch after expiration of the set elapsed time.

As may be seen in FIG. 1, the device 10 is set for one hour of elapsed time with all of the pixels visible creating the annular graphic ring of indicia on the face of the liquid crystal display and the digital time setting as 1:00 in the center of the ring of graphic indicia. FIG. 3 illustrates the appearance on the face of the display when there is 59 minutes remaining on the setting. FIG. 4 illustrates the display on the face when there is 45 minutes remaining, and FIG. 5 illustrates the appearance of the face when the set time has expired at the end of one hour or at the end of any time setting. The display thus provides a graphical count down timer using the graphic display as well as the numeric display to represent the time remaining of the set time. The annulus or the arcuate portion of the annulus graphic display and the digital display both diminish as time elapses until no radial line indicia are visible on the timer face, as illustrated in FIG. 5 and the digits then read 0:00. Time elapses in a clockwise direction.

The device may include an alarm and even a pre-alarm audible sound, each of which may be turned on and off utilizing the mode control button S4, and each of which may be triggered when the set time expires and a pre-set time before that time expires if there is a pre-alarm setting. Such alarm and pre-alarm settings are known in the digital watch art and have therefore not been described in detail herein.

In one preferred embodiment of the invention, there is a second sweep hand in the form of a moving radial pixel 34 which makes one revolution during each minute that the device is operating in the elapsed time mode. This pixel is of the same length, shape and location on the face of the display as the pixels which form the annular graphic ring. As this moving sweep hand pixel 34 moves over an expired time portion of the display, as illustrated in FIG. 4, it is visible as a moving "hand" or moving pixel. As it continues and moves over an unexpired portion of time of the graphic display, as illustrated in FIG. 3, it progressively cancels out one pixel at a time as it moves over those graphic ring pixels. It thereby appears as a moving disappearing hand on the face of the graphic display as it progresses over the unexpired pixels of the graphic display. It is thus visible as a moving sweep hand (FIG. 4) or as a moving disappearing hand 34*a*, as illustrated in FIG. 2, always moving in a clockwise direction and moving continuously until expiration of the set time.

Figure 6:
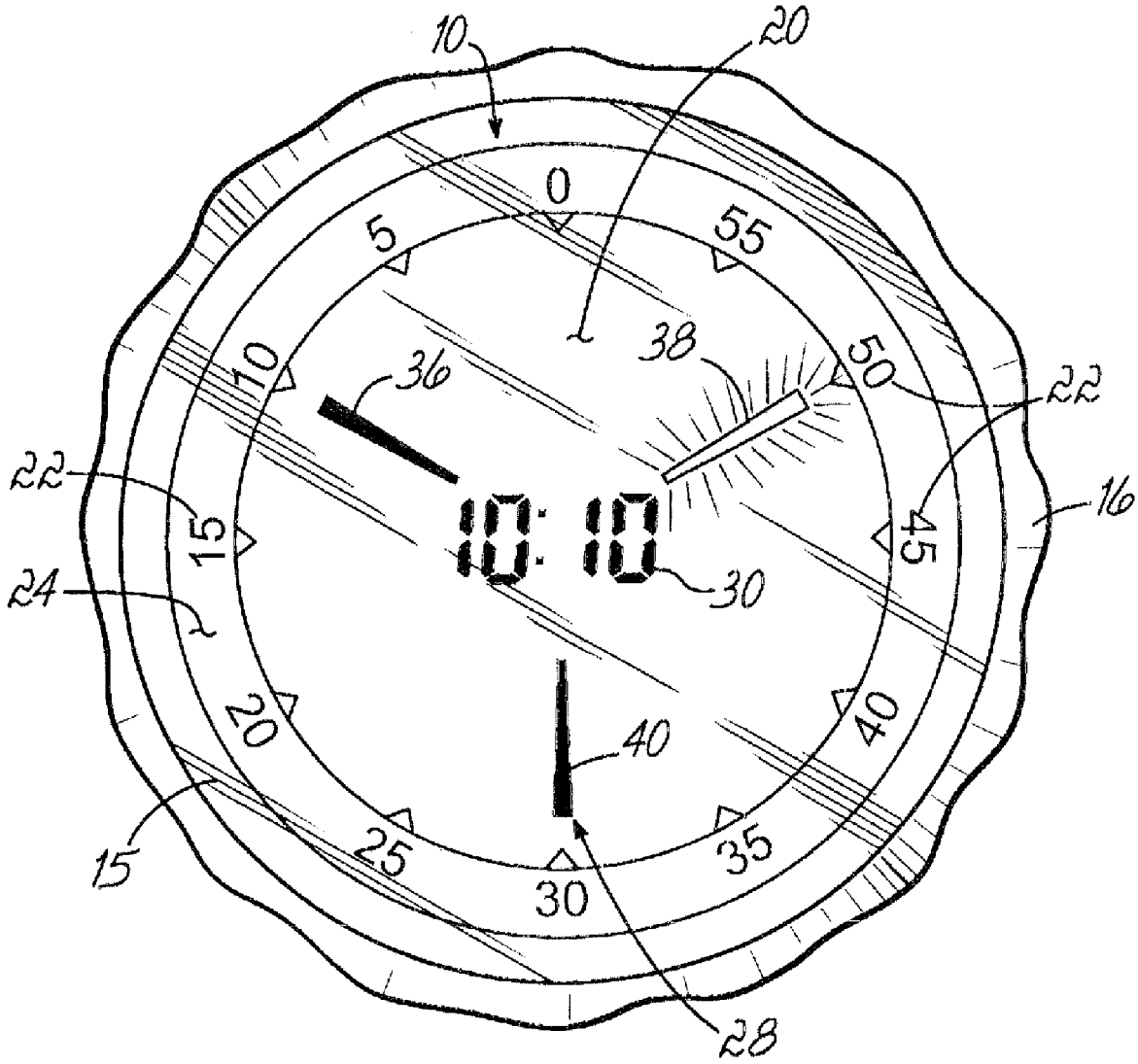
FIG. 6 is a front elevational view of the watch of FIG. 1, but set with the watch in the time-of-day mode.

With reference now to FIG. 6, there is illustrated the device 10 in the time-of-day mode. In this mode of the device, the time is displayed in the "analog" mode or in the form of three "hands" 36, 38, 40 movable around the periphery of the display face of the device. The time is also visible in a digital format in the center of the display face. The hour hand 36 of the time-of-day display is in the form of a wedge-shape pixel which is continuously lit, while the minute hand 38 is in the form of a wedge-shape pixel which is always flashing. The second hand is in the form of a continuously lit pixel 40 which continues to move and sweep around the display face of the device, making one revolution per minute, when the device is operating in the time-of-day mode. Pressing of the mode control button S4 affects changes from the time-of-day mode to the elapsed time mode or vice versa, as explained hereinabove.

Setting and Operation of the Device

Control and setting of the device is accomplished through the four buttons S1, S2, S3 and S4. The button S1 is used to enter setting modes. The button S2 is used to change the set field and to start and stop the elapsed time setting when the device is in the elapsed time mode. The buttons S3 and S4 are used to change the value of the field being set, and the button S1 is also used, when in the setting procedure, to exit setting modes. In order to set the timer to an elapsed time setting, the timer must be stopped by pressing the button S2 twice. The mode button S4 must then be pressed and held until the solid radial pixels of the graphic display appear if the device is to be set to an elapsed time setting. Thereafter, the button S1 is pushed and held down for several seconds until the numbers in the numerical display 30 begin to flash, indicating the device is then ready for setting of the elapsed time. With the numerical indicia flashing, the button S3 may be pushed to increase the timer set time from its original factory setting to a lesser time, or the button S4 may be pushed to decrease the elapsed time setting. This setting time may be anywhere from one minute where the digital display would read as 0:01 to up to twelve hours of elapsed time when the digital display would read as 12:00. The factory setting, or so-called default setting, of the device in the elapsed time mode is usually one hour which appears as a complete circle of the graphic pixels 28 and 1:00 on the digital numeric display. If at any time there is a desire to return to the original setting, both the buttons S3 and S4 are pushed simultaneously and held for several seconds, at which point in time the device returns to its original factory default setting, as illustrated in FIG. 1.

In order to set the time of day into the watch, the user first presses the mode button S4 to change to the time-of-day mode. In this mode, the current setting of the time of day will appear on the display face 20 (FIG. 6) of the liquid crystal display. If change is to be made on the time that appears on the face of the display, the user presses and holds the button S1 until the hour and minute displays of the digital numeric display in the center of the face of the display begin to flash, indicating that the device is now in the time set mode.

Initially, actuation of the button S3 or S4 will affect movement of the hour hand upon actuation of the buttons S3 or S4. After the hour hand has been correctly set, then pressing the button S2 once will cause the hour hand to become solid rather than flashing, and the device will enter the minute setting mode with the digit minute hand 38 and the second hand 40 flashing. At this juncture, the minute hand may be set to a desired time setting by pressing the buttons S3 or S4 to increase or decrease the value or setting of the minute hand of the digital display. After the minute hand has been correctly set, pressing the button S2 will result in the second hand flashing, at which point the buttons S3 or S4 may be pushed to set the second hand 40 to 0. To exit the time setting mode, the button S1 is pushed, which then causes the liquid crystal display to exit the time setting mode. Alternatively, if the time has been completely set, including that the time setting of the second hand to 0, leaving the device unattended for approximately 30 seconds causes the time setting changes to be saved. This is an alternative to pressing the button S1 to cause the new settings to be saved.

The mechanism 18, of course, includes a small liquid crystal display actuating battery (not shown) which is contained within the casing and underneath the inside cover 17 of the housing 16. That cover may be removed by set screws (not shown) or any other conventional watch case cover securing mechanism for purposes of replacement of the battery if it should become worn out.

While I have described only a single preferred embodiment of my invention, persons skilled in this art will appreciate numerous changes and modifications which may be made without departing from the spirit of the invention. Additionally, I have not disclosed the particular chip and control circuit utilized in association with the liquid crystal display described hereinabove because persons skilled in the art, with the description set forth hereinabove, will readily be able to supply such a control circuit and chip. I therefore do not intend to be limited except by the scope of the following appended claims.

I claim:

1. An elapsed time and remaining time measuring device comprising:

a display face;

an annular ring of electronically generated graphic indicia visible around the display face;

a digital numerical read-out display of elapsed times located on said display face;

at least one electronic control element for setting a desired elapsed set time into said device, which desired elapsed set time is indicated both as a digital read-out display and as a complete ring or an arcuate section of an annular ring on the display face;

an actuator for initiating progressive clockwise disappearing movement of said electronically generated graphic indicia so as to expose decreasing areas of the annular ring in a clockwise direction as time elapses until all graphic indicia disappears when the whole of the set time has elapsed; and said digital numerical display remaining synchronized with said graphic indicia so as to numerically display as well as graphically display remaining elapsed time.

2. The elapsed time and remaining time device of claim 1 wherein the display face is a liquid crystal display and the annular ring of graphic indicia comprises a plurality of pixels shaped as radial bars.

3. The elapsed time and remaining time measuring device of claim 1 which further includes a second sweep hand indicia operable to make one revolution of movement during each minute of operation of the elapsed time.

4. The elapsed time and remaining time device of claim 1 wherein said electronic control element is operable to set a desired elapsed set time of anywhere between one minute and multiple hours of time, with said desired set times being displayed both by said graphic indicia and said numerical display.

5. The elapsed time and remaining time device of claim 1 which is further operable in either a first elapsed time ode of operation and a second time-of-day mode, said device further including a mode control element for causing said device to operate in one or the other of said first and second modes of operation.

6. The elapsed time and remaining time device of claim 5 wherein said device, when in said time-of-day mode, displays said time of day in both analog and digital form.

7. The elapsed time and remaining time device of claim 6 wherein said device, when in said time-of-day mode, displays said analog time of day with three separate hand indicia, one of which hand indicia is a flashing hand indicia to distinguish it from the other hand indicia and the third hand indicia of which is a sweep hand indicia which makes one complete revolution during each minute of operation of the device in the time-of-day mode.

8. An elapsed time and remaining time measuring liquid crystal display device comprising:

a display face;

an annular ring of electronically generated graphic indicia visible on the display face;

a digital numerical read-out display of elapsed times located on said display face;

at least one electronic control element for setting a desired elapsed set time into said device, which desired elapsed set time is indicated both on the digital read-out display and as a complete ring or an arcuate section of an annular ring on the display face;

an actuator for initiating progressive clockwise disappearing movement of said electronically generated graphic indicia so as to expose decreasing areas of the annular ring as time elapses until all graphic indicia disappears when the whole of the set time has elapsed.

9. The elapsed time and remaining time liquid crystal display device of claim 8 wherein the digital numerical display remains synchronized with the graphic indicia as remaining time elapses on the face of the device.

10. An elapsed time and remaining time measuring device comprising:

a display face;

a plurality of numerical indicia marks arranged around the periphery of the display face in a generally clockwise pattern, successive numerical indicia marks decreasing in numerical value in a clockwise direction from a twelve o'clock position;

an annular ring of electronically generated graphic indicia visible on the display face and spaced inwardly from the peripheral numerical indicia;

a digital numerical read-out display of elapsed times located internally of said annular ring of graphic indicia;

at least one electronic control element for setting a desired elapsed set time into said device, which desired elapsed set time is indicated both as a complete ring or an arcuate section of the annular ring on the display face and as a digital read-out display;

an actuator for initiating progressive clockwise disappearing movement of said electronically generated graphic indicia so as to expose decreasing areas of the annular ring in a clockwise direction as time elapses until all graphic indicia disappears when the whole of the set time has elapsed; and said digital numerical display remaining synchronized with said graphic indicia so as to numerically display as well as graphically display remaining elapsed time.

11. The elapsed time and remaining time device of claim 10 wherein the display face is a liquid crystal display and the annular ring of graphic indicia comprises a plurality of pixels shaped as radial bars.

12. An elapsed time and remaining time measuring wrist watch comprising:

a display face having a plurality of numerical indicia marks arranged around the periphery in a generally clockwise pattern from a twelve o'clock position;

an annular ring of electronically generated graphic indicia visible on the display face and spaced inwardly from the peripheral numerical indicia;

a digital numerical read-out display of elapsed times located internally of said annular ring of graphic indicia;

at least one electronic control element for setting a desired elapsed set time into said device, which desired elapsed set time is indicated on the digital read-out display and as a complete ring or an arcuate section of the annular ring on the display face;

an actuator for initiating progressive disappearing movement of said electronically generated graphic indicia so as to expose decreasing areas of the annular ring as time elapses until all graphic indicia disappears when the whole of the set time has elapsed; and said digital numerical display remaining synchronized with said graphic indicia so as to numerically display as well as graphically display remaining elapsed time.

13. The elapsed time and remaining time wrist watch device of claim 12 wherein the display face is a liquid crystal display and the annular ring of graphic indicia comprises a plurality of pixels shaped as radial bars.

14. The elapsed time and remaining time wrist watch of claim 12 wherein numerical indicia marks on the display face are arranged in decreasing numerical value in a clockwise direction from a twelve o'clock position and said progressive disappearing movement of said annular ring of electronically generated graphic indicia disappear in a clockwise direction as time elapses.

15. The elapsed time and remaining time measuring wrist watch of claim 12 which further includes a second sweep hand indicia operable to make one revolution of movement during each minute of operation of the elapsed time.

16. The elapsed time and remaining time wrist watch of claim 12 wherein said electronic control element is operable to set a desired elapsed set time of anywhere between one minute and multiple hours of time, with said desired set time being displayed both by said graphic indicia and said numerical display.

17. The elapsed time and remaining time wrist watch of claim 12 which is further operable in either a first elapsed time mode of operation and a second time-of-day mode, said device further including a mode control element for causing said device to operate in one or the other of said first and second modes of operation.

18. The elapsed time and remaining time wrist watch of claim 17 wherein said watch, when in said time-of-day mode, displays said time of day in both analog and digital form.

19. The elapsed time and remaining time watch of claim 18 wherein said device, when in said time-of-day mode, displays said analog time of day with three separate hand indicia, one of which hand indicia is a flashing hand indicia to distinguish it from the other hand indicia and the third hand indicia of which is a sweep hand indicia which makes one complete revolution during each minute of operation of the device in the time-of-day mode.

20. An elapsed time and remaining time measuring liquid crystal display device comprising:

a display face;

an annular ring of electronically generated graphic indicia visible on the display face, which graphic indicia appear as a complete ring or an arcuate section of an annular ring of radially extending pixel bars on the display face; and an actuator for initiating progressive clockwise disappearing movement of said electronically generated graphic indicia so as to expose decreasing areas of the annular ring as time elapses until all graphic indicia disappears when the whole of the set time has elapsed.

21. The elapsed time and remaining time liquid crystal display device of claim 20 wherein there is a digital numerical display associated with the ring or arcuate section of the ring of graphic indicia which remains synchronized with the graphic indicia as remaining time elapses on the face of the device.

* * * * *